United States Patent [19]

Kato

[11] 3,973,698

[45] Aug. 10, 1976

[54] THRUSTING COCK

[75] Inventor: Noriyoshi Kato, Nagoya, Japan

[73] Assignee: Toppan Printing Co., Ltd., Tokyo, Japan

[22] Filed: May 19, 1975

[21] Appl. No.: 578,430

[30] Foreign Application Priority Data

Oct. 8, 1974 Japan ..... 49-121524[U]

[52] U.S. Cl. ..... 222/91

[51] Int. Cl.[2] ..... B67B 7/26

[58] Field of Search ..... 222/91, 90, 89, 80

[56] References Cited

UNITED STATES PATENTS 3,549,049 12/1970 Weber ..... 222/91

*Primary Examiner*—Allen N. Knowles
*Assistant Examiner*—Hadd Lane
*Attorney, Agent, or Firm*—Lerner, David, Littenberg & Samuel

[57] ABSTRACT

A thrusting cock which is used for pouring out the liquid contents of a paper container by being thrust into the wall portion of said container, and comprises: a cylindrical body portion; a flange portion integrally formed on the front end of said body portion; a double-edged knife attached to the front face of said flange portion; auxiliary knives attached to both surfaces of said double-edged knife; a spiral ridge formed between the rear ends of said auxiliary knives and the front portion of said flange; and a gasket provided between the rear end of said spiral ridge and the front face of said flange.

3 Claims, 5 Drawing Figures

THRUSTING COCK

BACKGROUND OF THE INVENTION

This invention relates to a thrusting cock used for paper containers containing beverages such as milk and fruit juices, liquid seasonings such as sauces, soy sauce, vinegar and dressings, and other liquid materials. More particularly, the invention relates to a thrusting cock used for pouring the contents out of a paper container.

Various kinds of paper containers are widely used for liquid materials since the containers are inexpensive and do not cause the public nuisance. When the seals of them are to be opened, however, it is necessary to rip open or take off the sealed portions and can not be easily closed again. Therefore it is not desirable for sanitary reasons. In addition, there are several other disadvantages that the contents are liable to give out flavor, absorb offensive odors and change in taste. On account of these reasons, the remaining contents in the paper containers, when they are opened, are usually transferred into other receptacles such as glass bottles, which are considerably troublesome for the users.

SUMMARY OF THE INVENTION

The object of the present invention is accordingly to provide an improved pouring cock which eliminates the above-mentioned disadvantages or inconveniences.

Another object of the present invention is to provide a thrusting cock which is used for pouring out the contents in a paper container without opening the sealed portion.

A further object of the present invention is to provide a thrusting cock which is easily pushed into the wall portion of a paper container.

Still a further object of the present invention is to provide a thrusting cock which has a thrusting head to pierce into the wall of a container even when it is made of somewhat stiff material such as paper coated or laminated with resin film.

Still more the object of the present invention is to provide a thrusting cock which makes an opening in the wall of a container and fixes itself to the wall without causing leakage of the contents.

In view of the above objects, the thrusting cock of the present invention comprises a cylindrical body portion; a flange portion integrally formed in the front portion of said cylindrical body portion; a double-edged knife attached on the front face of and perpendicular to the central portion of said flange, the double-edged portion of said knife having a pointed tip, rear edge portions and outwardly curved edges; auxiliary knives aligned in the same direction with and perpendicularly to said double-edged knife and having rearward inclined edges running from the middle portion of said double-edged portions leaving said tip portion of the double-edged knife; a spiral ridge formed between the rear ends of said auxiliary knives and the front portion of said flange; and a gasket provide between the rear end of said spiral ridge and the front face of said flange. In the above structure, said flange has a central opening which receives the rear end portions of said double-edged knife and auxiliary knives.

The double-edged knife of the thrusting cock described above may be provided with a pair of said auxiliary knives on each side thereof and the rear end of said cylindrical body portion is provided with a detachable cap to cover the open end of said cylindrical body portion.

In the practical use of the above-mentioned thrusting cock, it is firstly thrust into the wall portion of a container by hand, thereby cutting the wall by said double-edged knife and tearing open the cut portion of the wall by said auxiliary knives to form a hexagonal aperture. The thrusting cock is further screwed into the wall of fit the cock tightly to the wall portion. Thereby the inside of the container can be communicated to the outside through the opening of the flange, and the contents of the container can be poured out.

BRIEF DESCRIPTION OF THE DRAWINGS

The foregoing and other objects are effected by the invention as will be apparent from the following description and claims taken in connection with the accompanying drawings, forming a part of this application, in which:

FIG. 4, (*b*) is also a schematic illustration of the inside of said wall portion wherein a hexagonal aperture is formed by pushing the thrusting cock further into the wall portion.

DETAILED DESCRIPTION OF THE INVENTION

Figure 1:
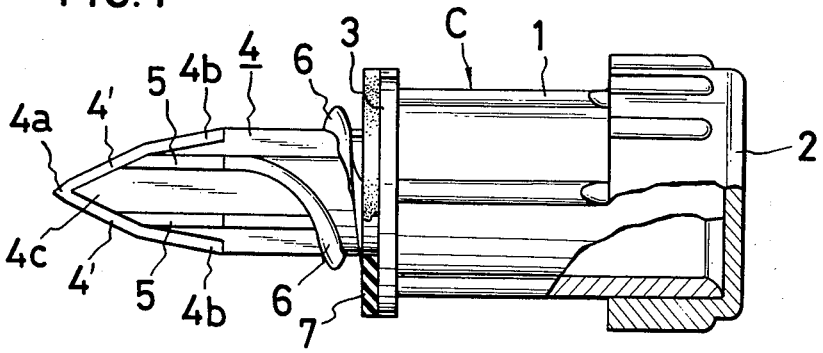
FIG. 1 is a partially cutaway plan view of the thrusting cock of the present invention.
Figure 2:
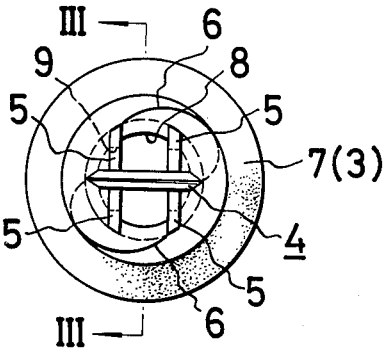
FIG. 2 is a rear side view of the thrusting cock shown in FIG. 1.
Figure 3:
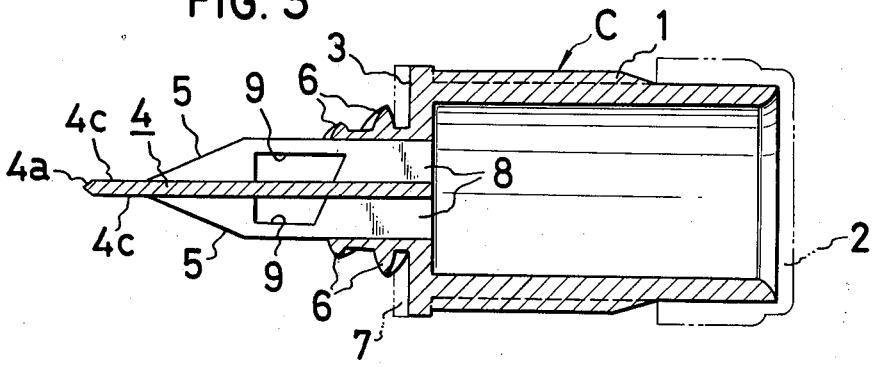
FIG. 3 is a vertical sectional view taken along the line III—III in FIG. 2.

Referring now to the drawings, an embodiment of the present invention is illustrated, in which the cock C comprises a cylindrical body portion 1 and one end of said body portion 1 is provided with a cap 2. The front end (the left side of FIG. 1) of said body portion 1 is integrally provided with a flange 3 and a double-edged knife 4. This double-edged knife 4 is positioned farther front side of the flange 3 and has a plate like configuration, that is a straight line in cross section. Furthermore, the double-edged knife 4 has a pointed tip 4*a*, rear ends of edges 4*b* and externally curved edges 4'. Each surface of the double-edged knife 4 is provided with a pair of auxiliary knives 5 in alignment with the axis of the former knife 4 and perpendicular to the surface of the same knife 4. The edges of the auxiliary knives 5 incline from the middle portions of said externally curved edges 4' to the rear direction (right side on FIG. 1) leaving front end surfaces 4*c*. Around the portion between the rear ends of the edges of auxiliary knives 5 and the front face of the above flange 3, a spiral ridge 6 is formed and further, a gasket 7 is attached between the rear end of said spiral ridge 6 and the front face of said flange 7. A center opening 8 is formed in the flange 3, which receives the rear end portions of the above-mentioned double-edged knife 4 and auxiliary knives 5. Further, the auxiliary knives 5 are provided with supplementary apertures 9 to communicate to the above center opening 8.

Figure 4A:
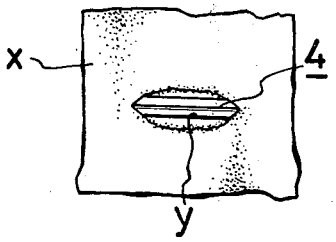
FIG. 4, (*a*) is a schematic illustration of the inside of a part of wall of a container when the thrusting cock is pushed thereto.
Figure 4B:
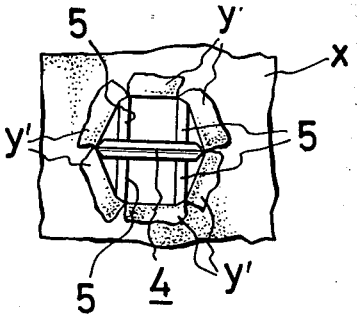

Having the above structure, the thrusting cock C of the present invention is pointed at the front end of the double-edged knife plate 4. Therefore the thrusting cock C can be easily thrusted into the wall portion of a paper container *x* with extremely low resistance. Thus a cut-open portion *y* in a straight line is formed in the wall of the container $x$ by the double-edged knife 4 (see FIG. 4, ($a$) ). When the double-edged knife 4 is further inserted into the wall portion, the cut-open portion $y$ is perpendicularly enlarged forming torn portions $y'$ by the parallel auxiliary knives 5 on both sides of the double-edged knife 4. The hexagonal opening can be thus formed as shown in FIG. 4, ($b$ ).

As disclosed in the above, the wall portion of a container is straightly cut in the first step by the double-edged knife 4 and, in the second step, the cut-open portion is torn open by the auxiliary knives 5 to form a hexagonal opening. Therefore, the insertion of the thrusting cock C can be easily carried out and the torn portions $y'$ are uniformly formed, and further the cock can be firmly screwed into the opening in the wall portion by the spiral ridge 6. In accordance with the present invention as noted above, the torn portions $y'$ and the surface of gasket 7 can be brought into close contact with each other, thus the leakage of the contents can be prevented in practical uses. This fact is very advantageous as compared with the conventional one which forms an opening crosswise. The characteristic features of the easiness of thrusting and the prevention of leakage in the present invention come from the two stepped process that the straight opening is formed in the first step by the double-edged knife 4 and, in the second step, said straight opening is torn crosswise by the auxiliary knives to form a hexagonal opening.

When the contents in the paper container is poured out, the liquid can pass through the spaces between the wall of center opening 8 and the rear end portions of both knives 4 and 5 without any obstruction.

Furthermore, when the cap 2 is taken off from the thrusting cock C, the cap 2 is liable to be turned counterclockwise, so that the spiral ridge 6 may be made a left-handed screw and the releasing of the cock body can be thus prevented.

As disclosed in the above, the thrusting cock of the present invention is simple in structure and convenient in use as compared with the conventional cocks of this kind. It should be emphasized, however, that the specific embodiments described and shown herein are intended as merely illustrative and in no way restrictive of the invention.

What is claimed is:

1. A thrusting cock which comprises: a cylindrical body portion; a flange portion integrally formed in the front portion of said body portion; a double-edged knife attached on the front face of and perpendicularly to the central part of said flange, the double-edged portion of said knife having a pointed tip, rear edge portions and outwardly curved edges; auxiliary knives aligned in the same direction with and perpendicularly to said double-edged knife and having rearward inclined edges running from the middle portion of said double-edged portions leaving said tip portion of the double-edged knife; a spiral ridge formed between the rear ends of said auxiliary knives and the front portion of said flange; and a gasket provided between the rear end of said spiral ridge and the front face of said flange; and the central opening of said flange receiving only the plate portions in the rear ends of both the said double-edged knife and auxiliary knives.

2. A thrusting cock as claimed in claim 1, in which each surface of said double-edged knife is provided with a pair of said auxiliary knives.

3. A thrusting cock as claimed in claim 1, in which the rear end of said cylindrical body portion is provided with a cap to cover the open end of said cylindrical body portion.

* * * * *